United States Patent [19]

Maldina

[11] 4,406,293

[45] Sep. 27, 1983

[54] ROD-BREAKING DEVICE

[75] Inventor: Paolo Maldina, Bologna, Italy

[73] Assignee: Sasib S.p.A., Bologna, Italy

[21] Appl. No.: 280,081

[22] Filed: Jul. 2, 1981

[30] Foreign Application Priority Data

Jul. 11, 1980 [IT] Italy ..... 12594 A/80

[51] Int. Cl.[3] ..... A24C 5/28

[52] U.S. Cl. ..... 131/84 R; 131/65; 131/84 C

[58] Field of Search ..... 225/98–106; 131/60, 65, 280, 84 R, 84 C

[56] References Cited

U.S. PATENT DOCUMENTS

| | | | |
|---|---|---|---|
| 1,790,342 | 1/1931 | Di Ianni | 131/60 |
| 3,244,050 | 4/1966 | Pym | 131/65 |
| 3,244,183 | 4/1966 | Pym | 131/65 |
| 4,226,352 | 10/1980 | Watson | 131/98 |

FOREIGN PATENT DOCUMENTS

| | | | |
|---|---|---|---|
| 1246490 | 8/1967 | Fed. Rep. of Germany | 131/65 |

*Primary Examiner*—V. Millin

*Attorney, Agent, or Firm*—Spencer & Kaye

[57] ABSTRACT

The rod-breaking device comprises a deflecting guide movable alternately across the normal straight path of a cigarette rod issuing from a rod-forming mechanism and entering the inlet of a rod-processing unit. The movement of the deflecting guide into active position serves to break the rod by cooperating with a fixed abutment, whereafter the deflecting guide stops in said active position to deflect the following rod out of the normal path. The movement of the deflecting guide into the opposite inactive position serves to break the rod and to bring the said deflecting guide to an inactive position out of the normal path of the rod. A transverse blade is secured on the deflecting guide in such a manner as to move, across the normal path of the cigarette rod, close to the inlet of the processing unit. Upon stopping of the cigarette-making machine the deflecting guide and blade are moved into active position, thus leading to the elimination of a segment of rod delimited downstream by the clean cut effected by the blade and upstream by the break effected by the cooperation of the deflecting guide with the fixed abutment.

3 Claims, 5 Drawing Figures

ROD-BREAKING DEVICE

BACKGROUND AND SUMMARY OF THE INVENTION

The present invention relates to continuous-rod cigarette-making machines, and more particularly it concerns improvements in the rod-breaking devices for such machines.

In a continuous-rod cigarette-making machine, a moving cigarette rod is formed by wrapping a moving cigarette paper web about a tobacco filler in a rod-forming mechanism, the continuous rod then passing to a cutter mechanism it is severed into individual cigarette lengths. Normally, the rod-forming mechanism includes a paster which applies adhesive to one edge of the paper web, said edge then being folded to overlap the other edge of the web and adhere thereto, and a heater to seal the overlapping adhering edges.

When the machine is started, the rod issuing from the rod-forming mechanism is initially unsuitable for producing satisfactory cigarettes, because it may be not correctly sealed or contain insufficient tobacco filler. Therefore, at each starting operation, the initial portion of the freshly produced rod is deflected to a waste receptacle and when the rod produced becomes satisfactory, it is broken to separate the suitable rod being produced from the rod which has been deflected to the waste receptacle, and allow the leading end of the rod behind the break to proceed along the normal straight path to the cutter mechanism.

Moreover, it has been also found desirable to break the continuous cigarette rod whenever the machine is stopped. A segment of the rod remains, after this breaking, in the guide members guiding to the cutter mechanism, or in the detector unit (usually arranged prior to the cutter mechanism) in which the specific weight of the tobacco filler of the cigarette rod is sensed. The said rod segment must be pneumatically expelled, in order to permit to start again the machine.

According to British Pat. No. 1,547,763, it has been proposed a rod-breaking device comprising a guide member adapted to be moved across the path of the rod, in which movement of said guide member in one direction serves to break the rod, whereafter the guide member stops in such a position as to deflect the following rod out of the normal straight path: the above operation is required upon stopping of the machine and (after starting of the machine) for the disposal of the initially unsuitable rod. The movement of the guide member in the opposite direction serves to break the rod and to bring the said guide member to a position outside the normal straight path of the rod: this latter operation is required for the feeding of the rod to the cutter mechanism or to the detector mechanism, after having reached satisfactory condition of the rod being produced. The breaking of the rod upon stopping of the machine is obtained by cooperation of the guide member which, during its movement across the path of the moving rod, forces the moving rod against a fixed abutment, thus deflecting and breaking it.

The above mentioned rod-breaking device presents the drawback that, whenever the machine is stopped, the breaking of the rod, subsequent to the cooperation of the moving guide member and of the fixed abutment, leads to some deformation of the rod in the portion immediately downstream of the break point. This deformed portion constitutes the tail portion of the rod segment which remains inserted in the guide members which lead to the cutter mechanism, or in the tubular guide member of the detector mechanism for sensing the specific weight of the tobacco filler. Usually, the said rod segment is expelled from the said guide members by pneumatic means, such as air blows. The presence of the said deformed tail portion may lead to jamming of the rod segment in the guide members, which constitutes an obstacle to the pneumatic expulsion of the rod segment itself. In consideration of the fact that the starting of the machine is subject to the condition of the previous removal of any rod segment, it is of the greatest importance to provide a rod breaking device which, upon stopping of the machine, provides to the expulsion of any deformed portion of the tail section of the rod after the breaking of the rod itself.

According to the present invention, there is provided a rod breaking device of the type above referred to, characterized by the fact that a transverse blade is operatively associated with the movable guide member which breaks the rod, said blade being movable across the normal straight path of the cigarette rod, close to the inlet of the processing unit (cutter mechanism or weight detector unit), in such a manner that upon movement of the guide member to break the rod at the stopping of the machine, the said transverse blade moves concurrently with the guide member and cuts with a clean cut the tail portion of the cigarette rod entering the inlet of the processing unit, thus eliminating the deformed segment of rod delimited downstream by the said cut effected by the blade, and upstream by the break effected by the cooperation of the guide member with the fixed abutment.

According to a preferred embodiment, the said transverse blade is secured on the said guide member, and the cutting edge of the blade is in substantial alignment with the portion of the deflecting guide which cooperates with the fixed abutment for breaking the rod, so that the breaking of the rod effected by the cooperation of the moving guide member with the fixed abutment, and the cutting of the rod effected by the blade, take place simultaneously and are both controlled by the single movement of the guide member across the normal straight path of the continuous rod.

The above and other features of the invention, and the advantages deriving therefrom, will appear evident from the following description of a preferred embodiment, made with reference to the Figures of the attached drawings.

BRIEF DESCRIPTION OF THE DRAWINGS

FIG. 6 shows the same view of the rod-breaking device shown in FIG. 1 in combination with components of a rod-processing machine.

DESCRIPTION OF THE PREFERRED EMBODIMENT

Referring to the Figures, a continuous cigarette rod B is carried by a conveyor band 6 from a rod-forming mechanism (not shown) until it reaches the downstream end of band 6, where the band 6 travels round a pulley 7, while the cigarette rod B continues in a straight path for a short distance, until it reaches the inlet 8 of a subsequent processing unit 9, such as for example a cutter unit which cuts the cigarette rod into predetermined cigarette lengths, or a detector unit in which the specific weight of the tobacco filler of the cigarette rod is sensed.

Figure 4:
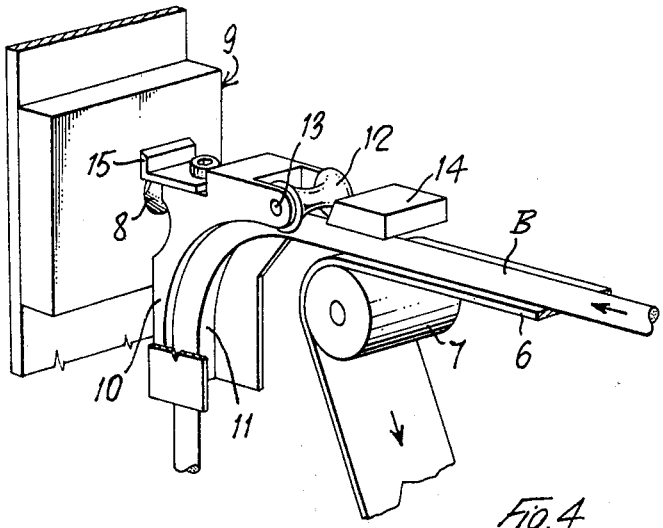
FIG. 4 is a perspective view showing the rod-breaking device in its active position, operatively subsequent to the position of FIG. 3, with the rod being deflected to a waste receptacle, as it is required upon starting the cigarette-making machine.

In the straight path of cigarette rod B, between the downstream end of band 6 and the inlet 8, there is arranged a rod-breaking and deflecting device which comprises a deflecting guide 10 movable up-and-down alternately under the action of suitable control means (not shown) from an inactive position, in which the said deflecting guide 10 does not interfere with the straight path movement of the cigarette rod B from downstream end of band 6 to inlet 8 (see FIGS. 1—full lines—and 2), to an active position in which the said deflecting guide 10 interferes with the cigarette rod B delivered by band 6 causing same to engage the curved surface 11 which deflects the rod B downward to a waste receptacle (FIG. 4).

The entrance of the cigarette rod B to the curved surface 11 of the deflecting guide 10 is favoured by the grooved roller 12, which is supported freely rotatable around pin 13 at the entrance end of the said curved surface 11.

Downstream of the said roller 12, on the deflecting guide 10 there is secured, by means of screws 16, an upwardly directed transverse blade 15, the cutting edge of which lies substantially at the same level of the said grooved roller 12. Following to the up-and-down alternate movement of the deflecting guide 10, the said blade 15 is moved very close to the surface presenting the inlet 8 of the subsequent processing unit 9, in such a manner as to intercept the opening of said inlet 8, thereby cutting, in its upward movement, the cigarette rod B which enters the said inlet 8.

The rod-breaking and deflecting device according to the invention is completed by an upper fixed abutment 14 located above the downstream end of band 6, close to the cigarette rod B running therebelow.

Figure 1:
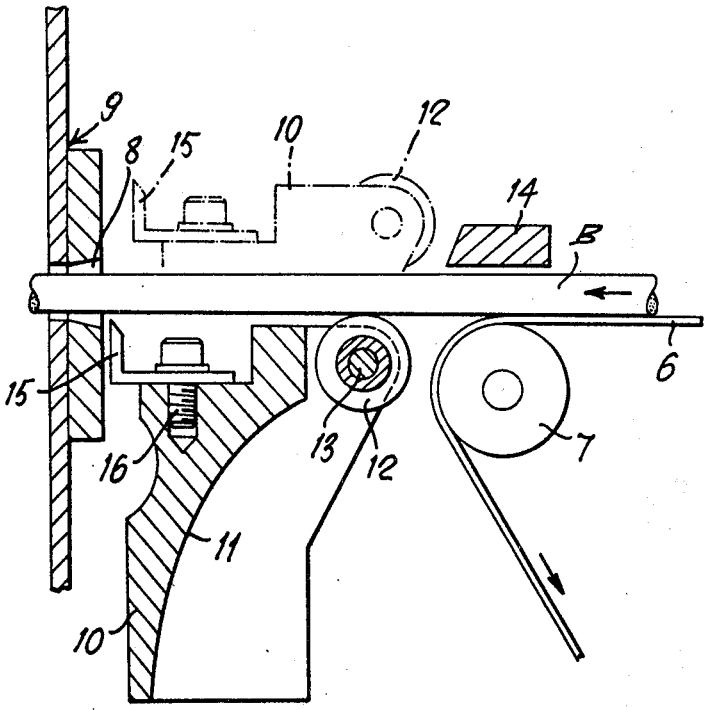
FIG. 1 is a longitudinal side section of a rod-breaking device according to the invention.
Figure 2:
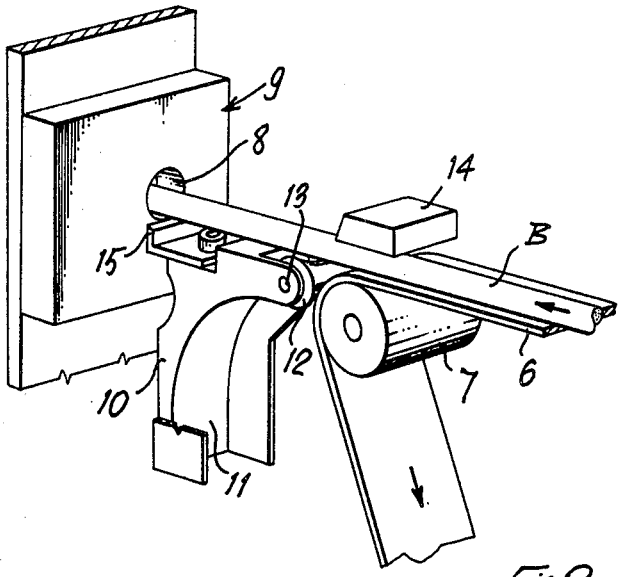
FIG. 2 is a perspective view showing the rod-breaking device in its inactive position, during normal operation of the cigarette-making machine.

The operation of the just described rod-breaking and deflecting device is the following:

With reference to FIG. 1 (full lines) and FIG. 2 there is illustrated a condition of normal operation of a cigarette-making machine incorporating the rod-breaking device according to the invention. Under this normal operation condition, the cigarette rod B is travelling along its straight horizontal path from the rod-forming device to the subsequent processing unit 9. The deflecting guide 10 is in its downward, inactive position, out of the path of the cigarette rod B.

Figure 3:
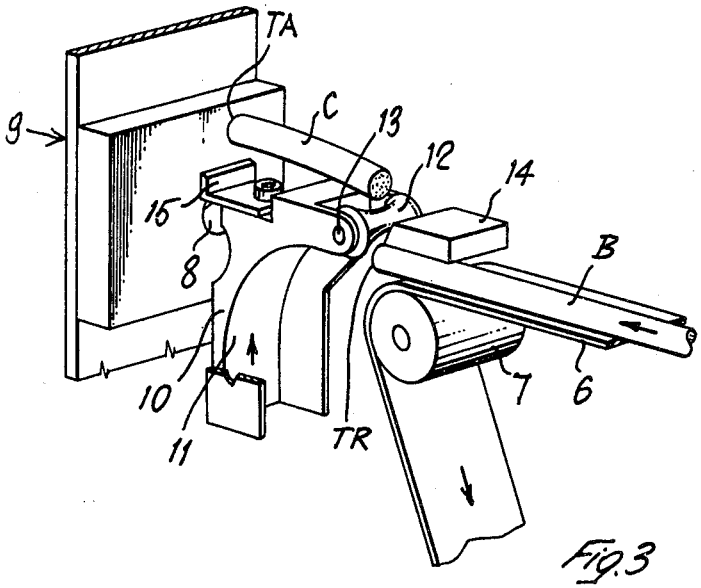
FIG. 3 is a perspective view showing the rod-breaking device at the moment of breaking the rod when the machine is stopped.

Whenever the cigarette-making machine is stopped (for any reason), the deflecting guide 10 is moved upwardly to its active position in a snap manner, so that it deflects the rod upwardly, with its roller 12, forcing it against the abutment 14 and thus breaking the rod at the break point TR (see FIG. 3).

At the same time, the blade 15, integral in its movement with the deflecting guide 10, cuts the tail C of the leading end of the rod B, at the cutting point TA, close to the opening of the inlet 8. The portion C of the rod B between the points TR and TA, which portion contains the deformed part, is thus expelled, so that the remaining leading portion of the rod can be also more easily expelled from the processing unit 9, under the action of pneumatic means (not shown). Afterwards, the deflecting guide 10 is left in the said active position so that, at the subsequent re-starting of the cigarette making machine (FIG. 4) it intercepts the cigarette rod B and deflects same downwardly along curved surface 11 to a waste receptacle (not shown).

Figure 5:
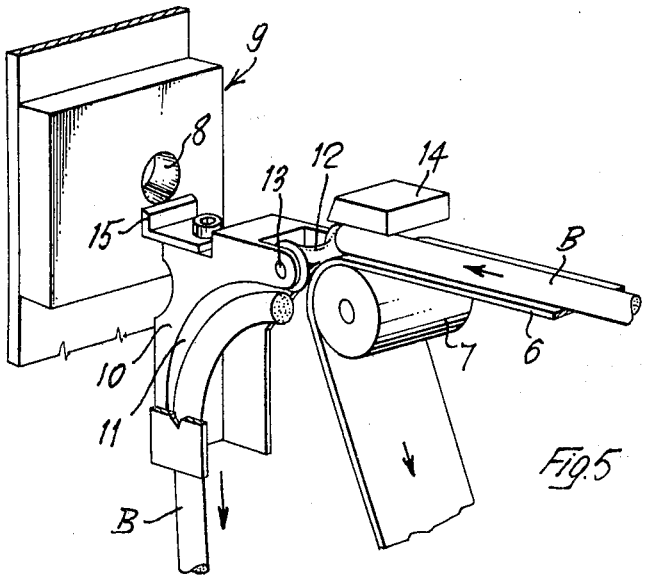
FIG. 5 is a perspective view showing the rod-breaking device at the moment of breaking the rod when the rod produced by the rod-forming device becomes suitable for producing cigarettes, the device being brought to its inactive position, operatively subsequent to the position of FIG. 4.

When the cigarette rod B has reached satisfactory production features, the deflecting guide 10 is snap-moved to its lower inactive position, and, during the said movement it deflects with roller 12 the rod B around the pulley 7 and the rod is thereby overstressed and breaks above the pulley 7, as indicated in FIG. 5. After this movement, the deflecting guide 10 remains in its lower, inactive position and the freshly produced rod B continues its straight path, resuming the condition of normal operation illustrated in FIG. 2, entering the inlet 8 of the processing unit 9.

The transverse blade 15 can be mounted also in those rod-breaking devices in which the deflecting guide 10 does not present the roller 12, but it presents a breaking edge which is adapted to cooperate alternately with either one of two fixed abutments arranged at the same position of the abutment 14, respectively above and below the path of the cigarette rod B after the downstream end of band 6. A breaking device of this type is illustrated in the mentioned British Pat. No. 1,547,763.

The fixed abutment 14 need not be fixed in the absolute sense; it must be sufficiently firmly mounted to remain stationary when the rod B is forced against it, but it can be conveniently secured to the cigarette rod heater, which is movably mounted and is lifted when the machine is not running.

According to the invention if, upon starting of the cigarette-making machine, after the downward movement of the deflecting guide 10 from its active position to its inactive position, the freshly produced cigarette rod B does not enter the inlet 8 of the processing unit 9, the deflecting guide 10 returns automatically into its active deflecting position, and thereafter again into its inactive position, one or more times, until the freshly produced rod B correctly enters the inlet 8. The failure of the correct entrance of the rod is signalled by two photocells light barriers 21 and 22 each of which may include a light source and a photo cell which sense the simultaneous presence of the cigarette rod downstream of the detector 23 unit, and of the cigarettes downstream of the cutter unit 24 as shown in FIG. 6.

The invention is not limited to the just described embodiment, but it can be broadly modified, particularly in the constructive details, without departing from the inventive principle, as above described and claimed hereafter.

I claim:

1. A rod-breaking device for a continuous-rod cigarette-making machine, comprising a deflecting guide (10) adapted to be moved across the normal straight path of a cigarette rod (B) issuing from a rod-forming mechanism of said machine and entering the inlet (8) of a rod-processing unit, in which the movement of said deflecting guide (10) in a first direction, into an active position causes movement of a portion of said deflecting guide from below to above the normal straight path of the rod, such movement of said portion serving to break the rod by cooperating with an edge of a fixed abutment (14) arranged above the normal straight path of the rod (B), the deflecting guide including a deflecting surface that is located such that when the deflecting guide (10) stops in the active position the rod is deflected out of the said normal straight path by the deflecting surface, while movement of the said deflecting guide (10) in the opposite second direction, into an inactive position, serves to break the rod and to bring the said deflecting guide (10) to a position outside of the normal straight path of said rod, characterized by the fact that a transverse blade (15) is operatively associated with the said deflecting guide (10), said blade (15) being movable across the normal straight path of the cigarette rod (B) close to the inlet (8) of the processing unit, in such a manner that during the movement of the deflecting guide (10) in the said first direction, the said blade (15) moves concurrently with the said deflecting guide (10) and cuts with a clean cut the tail portion of the cigarette and rod entering the inlet (8) of the processing unit, thus eliminating a segment of rod delimited downstream by the said cut effected by the blade (15) and upstream by the break effected by the cooperation of the deflecting guide (10) with the fixed abutment (14).

2. A rod-breaking device according to claim 1, characterized by the fact that the said transverse blade (15) is secured on the said deflecting guide (10), and the cutting edge of said blade is in substantial alignment with the portion of the deflecting guide which cooperates with the edge of the fixed abutment (14) for breaking the rod, whereby said blade, abutment and portion of the deflecting guide are arranged relative to the normal straight path of the rod so that the said breaking of the rod effected by cooperation of the deflecting guide with the fixed abutment and said cutting of the rod effected by the blade, tend to take place simultaneously and are both controlled by the single movement of the deflecting guide (10) in the first direction.

3. A rod-breaking device according to any one of the preceding claims 1 or 2, characterized by the fact that sensing means such as photocells are provided for sensing the presence of the rod (B) downstream of a detector unit which determines the specific weight of the tobacco filler and the simultaneous presence of the cigarettes downstream of the cutter unit, said photocells emitting signals for controlling the movement of the deflecting guide and associated blade so as to bring them from the inactive position to the active position and thereafter back to the inactive position, this cycle being repeated as many times as required, in order to ensure the correct entering of the freshly produced cigarette rod into the inlet (8) of the processing unit (9) comprising the said detector unit and cutter unit.

* * * * *